US006926522B2

(12) United States Patent
Townsend et al.

(10) Patent No.: US 6,926,522 B2
(45) Date of Patent: Aug. 9, 2005

(54) METHOD AND APPARATUS FOR PREHEATING PARTICULATE MATERIAL

(75) Inventors: John P. Townsend, Whitehall, PA (US); Charles R. Euston, Hamburg, PA (US); Douglas P. Freeman, Hamburg, PA (US); Michael E. Prokesch, Zionhill, PA (US)

(73) Assignee: FFE Minerals USA Inc., Bethlehem, PA (US)

( * ) Notice: Subject to any disclaimer, the term of this patent is extended or adjusted under 35 U.S.C. 154(b) by 26 days.

(21) Appl. No.: 10/676,885

(22) Filed: Sep. 30, 2003

(65) Prior Publication Data

US 2005/0069832 A1 Mar. 31, 2005

(51) Int. Cl.[7] ..... F27B 9/22

(52) U.S. Cl. ..... 432/136; 432/96; 432/98; 432/102; 432/139; 432/153; 432/154

(58) Field of Search ..... 432/95, 98, 99, 432/105, 106, 136, 139, 153, 154, 96, 102; 110/278, 267, 268, 281, 285, 289, 290, 291

(56) References Cited

U.S. PATENT DOCUMENTS 4,602,572 A * 7/1986 Giaier et al. ..... 110/342
4,767,322 A * 8/1988 Beckenbach et al. ..... 432/99
5,915,959 A * 6/1999 Gardner ..... 432/99

* cited by examiner

*Primary Examiner*—Jiping Lu
(74) *Attorney, Agent, or Firm*—Daniel De Joseph

(57) ABSTRACT

An apparatus for preheating particulate material in which the particulate material is transferred from one or more upper storage bins to a circular lower chamber that has an outer, essentially annular, portion which serves as a gas flow passage. The particulate material is directed from the feed bin or bins into a plurality of essentially vertical cylindrical feed cassettes via intermediate feed ducts. The lower chamber has a flat roof which is in contact with the bottom portion of the vertical feed cassettes. The vertical feed cassettes are approximately evenly spaced on top of the outer perimeter of the flat roof. The particulate material is preheated in the annular flow passage by hot kiln gases flowing in countercurrent heat exchange relationship with the particulate material. Each feed cassette is completely segregated from its adjacent cassettes, and the bottom of each cassette is positioned over a hole in the flat roof of the lower chamber to thereby enable the particulate material to fall from each cassette into the annular flow passage section of the lower chamber. A plurality of particulate discharge mechanisms, the number of which correspond to the number of cassettes, discharges particulate material that has fallen into the annular flow chamber from the overhanging cassettes into a material outlet located in the floor located at the center of the lower chamber.

22 Claims, 6 Drawing Sheets

METHOD AND APPARATUS FOR PREHEATING PARTICULATE MATERIAL

BACKGROUND OF THE INVENTION

The present invention relates to a method and apparatus for preheating material with the hot gas being exhausted from a heater or kiln.

Preheaters are commonly used for preheating particulate material, including preheating limestone. Limestone is generally preheated by directing hot exhaust gases from a rotary calcining kiln through the limestone particulate material in counter-current flow prior to the limestone entering the calcining kiln. The gases heat the limestone particles prior to their introduction to the rotary kiln, thus requiring less heating in the rotary kiln to complete the calcining process, thus making the calcining process more energy efficient. Preheating apparatuses of this general type are known in the art.

SUMMARY OF THE INVENTION

The present invention is an improved method and apparatus for preheating particulate material.

According to the present invention, there is an apparatus for preheating particulate material in which the particulate material is transferred from one or more upper storage feed bins to a basically circular lower chamber that has an outer, essentially annular, area which serves as an annular gas/material preheating passage.

It is an essential feature of the present invention that the particulate material is directed from the feed bin or bins via intermediate feed ducts into at least one, and preferably, a plurality of vertical and essentially cylindrical feed and initial preheating cassettes. The lower chamber has a roof, preferably a flat roof, which is in contact with the bottom portion of the vertical feed cassettes. The vertical feed cassettes are preferably approximately evenly spaced around the top of the outer perimeter of the roof, and, further, are preferably evenly spaced from the perimeter of the roof. The particulate material is preheated in first the vertical feed cassettes and then the annular flow passage by hot kiln gases flowing in countercurrent heat exchange relationship with the particulate material. The roof has a plurality of holes therethrough, with each hole being positioned above the annular flow passage. The holes serve the dual function of providing the inlet through which particulate material enters the lower chamber and the outlet via which preheating gas exits the lower chamber. Each feed cassette is positioned over at least one hole. Each feed cassette is completely segregated from its adjacent cassettes. The particulate material will fall from each cassette into the annular flow passage section of the lower chamber. A plurality of particulate discharge mechanisms discharge particulate material that has fallen into the annular flow chamber from the overhanging cassettes into a material outlet located in the center of the lower chamber's floor. Preferably, the discharge mechanisms are reciprocal rams, and their number will equal the number of cassettes.

BRIEF DESCRIPTION OF THE DRAWINGS

For a complete understanding of the present invention, reference can be made to the detailed description which follows and to the accompanying drawings, in which.

Like numerals in different drawings refer to similar elements.

DETAILED DESCRIPTION OF THE INVENTION

Figure 1:
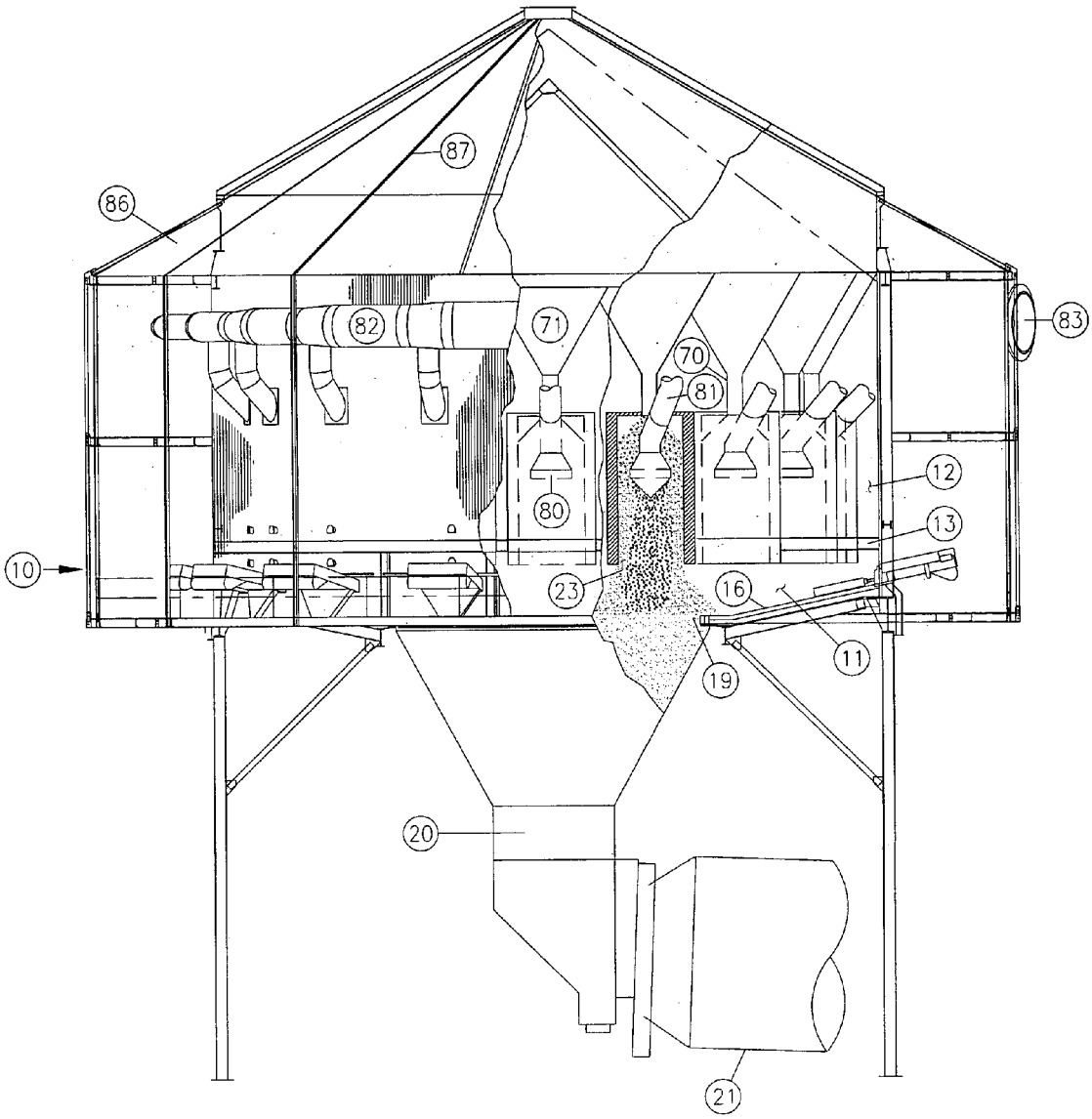
FIG. 1 is an elevational view of a preheater incorporating the present invention shown partly in cross section and with portions of the exterior wall broken away.
Figure 2:
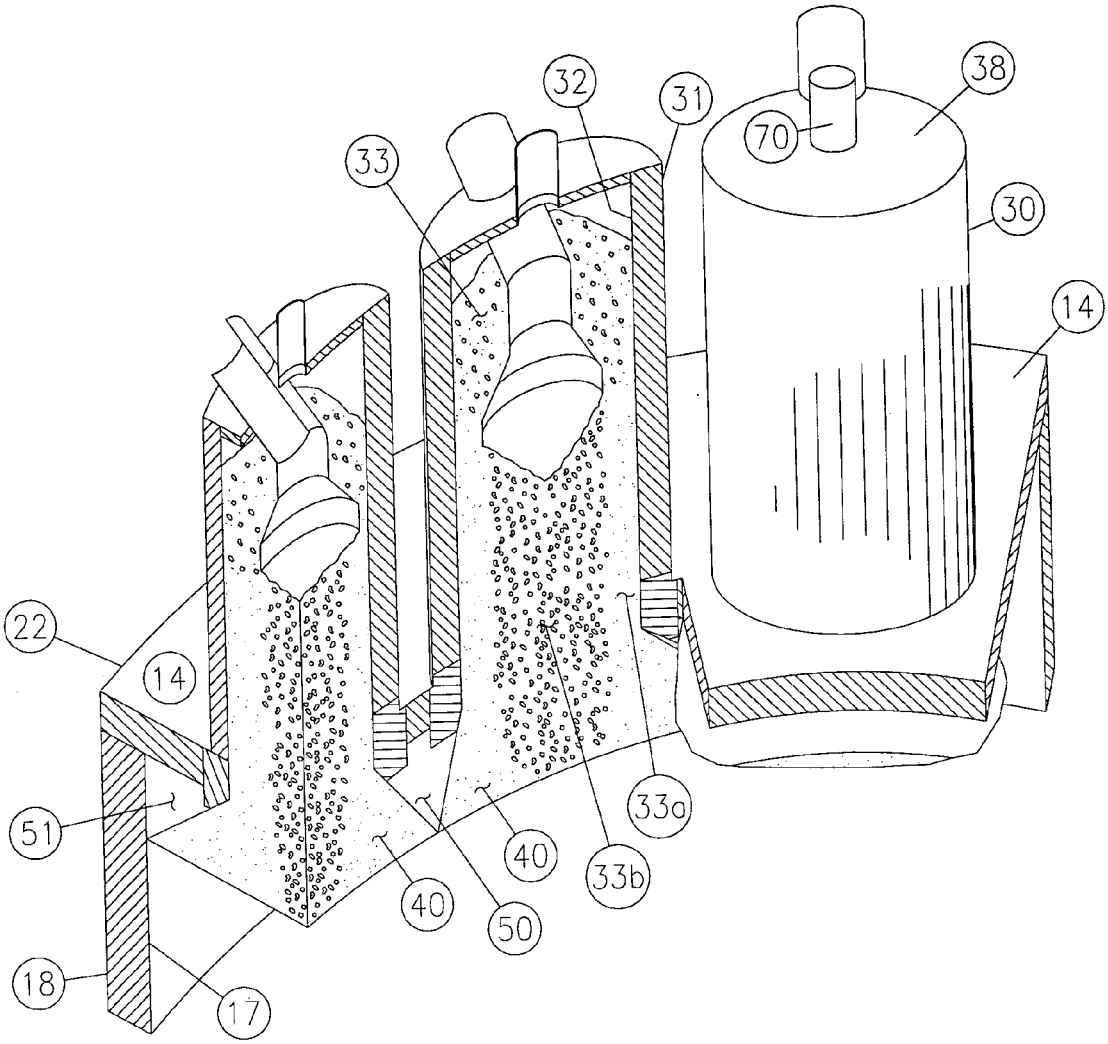
FIG. 2 is an over head perspective, shown partially in cross section, of three feed cassettes utilized in the present invention.
Figure 4:
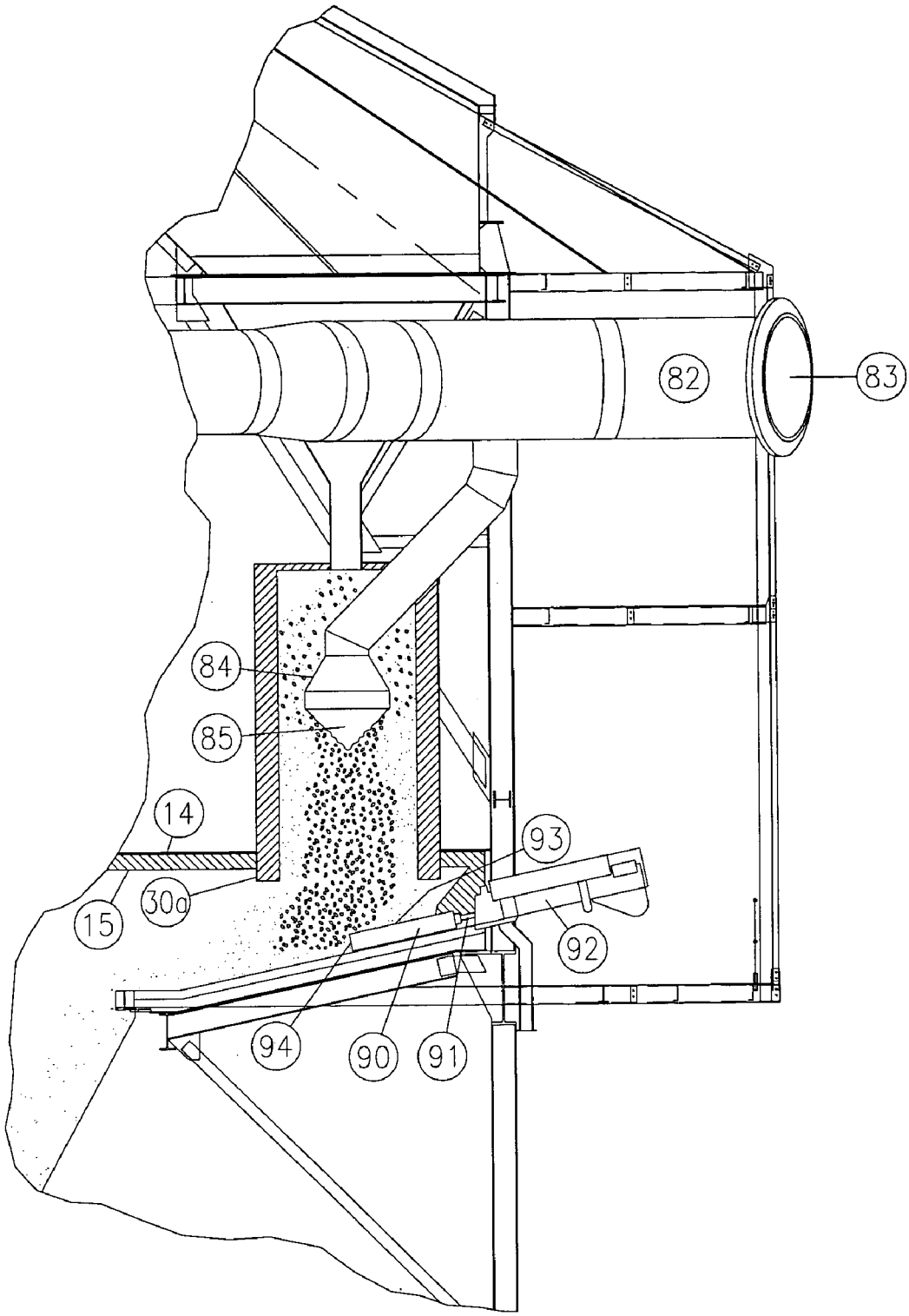
FIG. 4 is a sectional view taken along the line 4—4 of FIG. 3 looking in the direction of the arrows.

Referring first to FIGS. 1, 2 and 4, the present invention is a preheater 10 which consists of a lower preheating area 11 and an upper feed delivery and initial preheating area 12. The preheater 10 can be used with a large variety of particulate materials, but is particularly designed and intended to preheat and precalcine limestone. The preheater 10 can also be used with a variety of heating fluids, but is particularly designed and intended to heat with exhaust gases received from a calcining kiln.

Lower preheating area 11 is an upright, essentially circular, area. Lower preheating area 11 is separated from initial preheating area 12 by a flat roof 13 having upper surface 14, lower surface 15 and perimeter 22. Lower preheating area 11 has a sloped floor 16 and vertical inner and outer side walls 17, 18. At the center of floor 16 there is an initial central discharge area 19 through which material passes to the preheater discharge 20 after which it is delivered to rotary kiln 21. Unlike certain prior art preheaters that have a number of compartments in their preheating chamber, in the present preheater lower preheating chamber 11 has essentially no internal dividers so that if the chamber were empty of material there would be an unimpeded passage completely around its inner perimeter.

Upper preheating area 12 is comprised of a plurality of vertical feed and initial preheating cassettes 30, having outer wall 31, inner wall 32 and upper side 38, which are fed feed from feed bins 71 via material inlet and feed duct 70. Particulate material is initially preheated in cassette 30 after which it is delivered to lower preheating area 11. Upper preheating area 12 is enclosed by side walls 85 and roof 86, which in the depicted embodiment is conical, but can have other configurations, depending on the shape of the feed bins and/or the space requirements of the end user. Roof 86 is supported in part by roof supports 87.

Flat roof 13 of the lower preheater area 11 has a number of holes 23 through which particulate material enters and preheating gas exits lower preheating area 11. Preferably, above each hole 23 there is positioned a separate vertical feed cassette 30. In the preferred embodiment, holes 23 are preferable arranged in a ring or a semicircle near the perimeter 22 of roof 13. In operation, particulate material 33 is discharged into lower preheater area 11 by gravity, traveling down through each vertical feed cassette 30, through roof 13 to land on or above sloped floor 16, down sloped floor 16 to central discharge 19 and then eventually out preheater discharge 20 through which it is delivered to kiln 21. In flowing downwardly through the feed cassette 30 and lower preheater area 11, the particulate material 36 is preheated and precalcined by the countercurrent flow of the hot kiln gases which flow upwardly from the kiln 21, into lower preheating area 11, through holes 23 into cassette 30, in which said kiln gas will rise and pass through the particulate material 33 in said feed cassette 30. Preheating air will exit each cassette 30 through an air takeoff 80 located in the interior and in the upper region of each cassette 30 and, preferably, in the center of the interior of cassette 30. From air takeoff 80 exiting air travels to duct 81 in which it exits cassette 30 and thereafter travels to common air duct 82 which is located on the outside of the preheater and then to air outlet 83, from which it will be directed to a dust collector (not shown).

Figure 3:
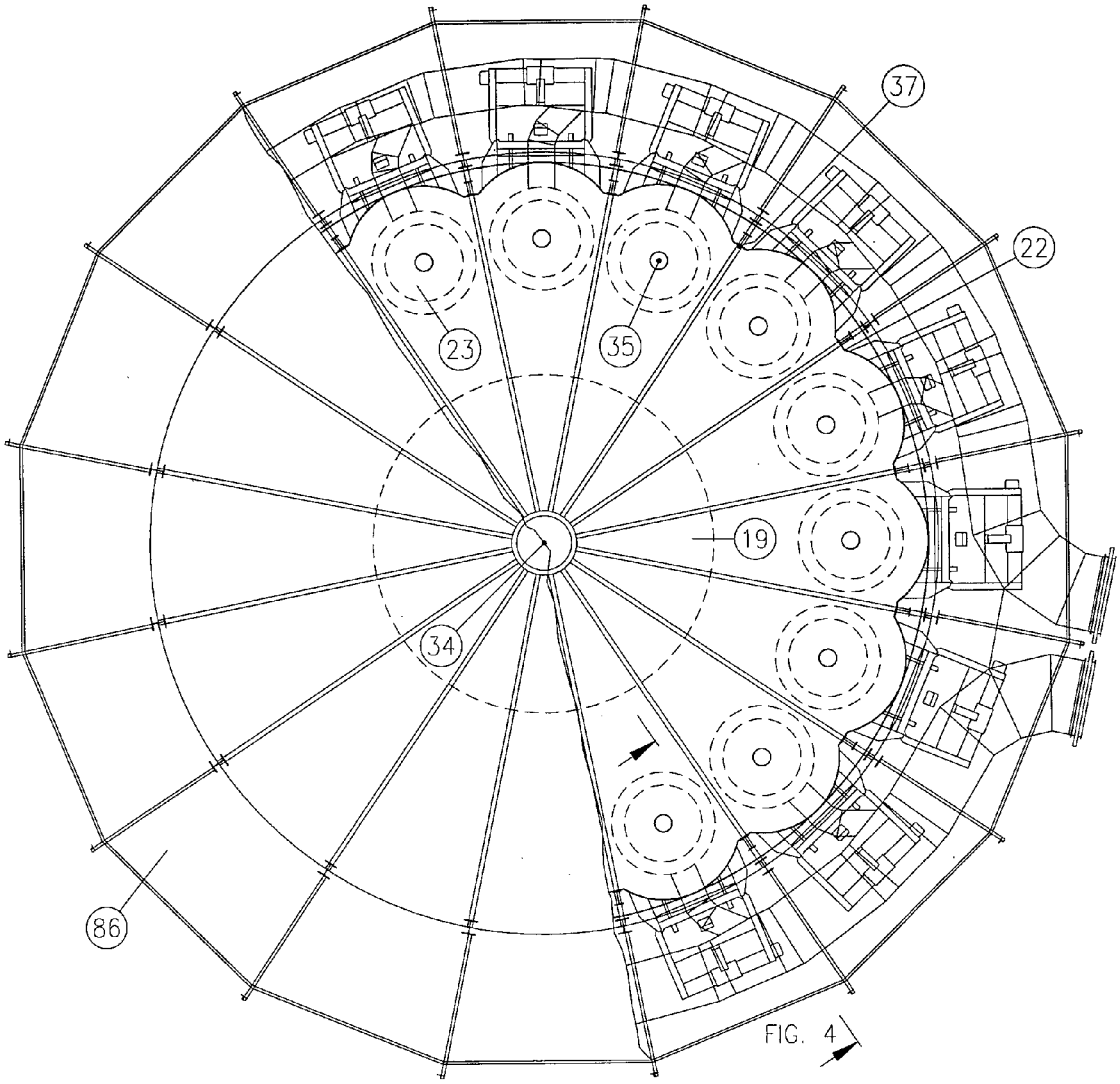
FIG. 3 is a top-plan view, partially in relief and partially in cross section, of the preheater shown in FIG. 1.
Figure 5:
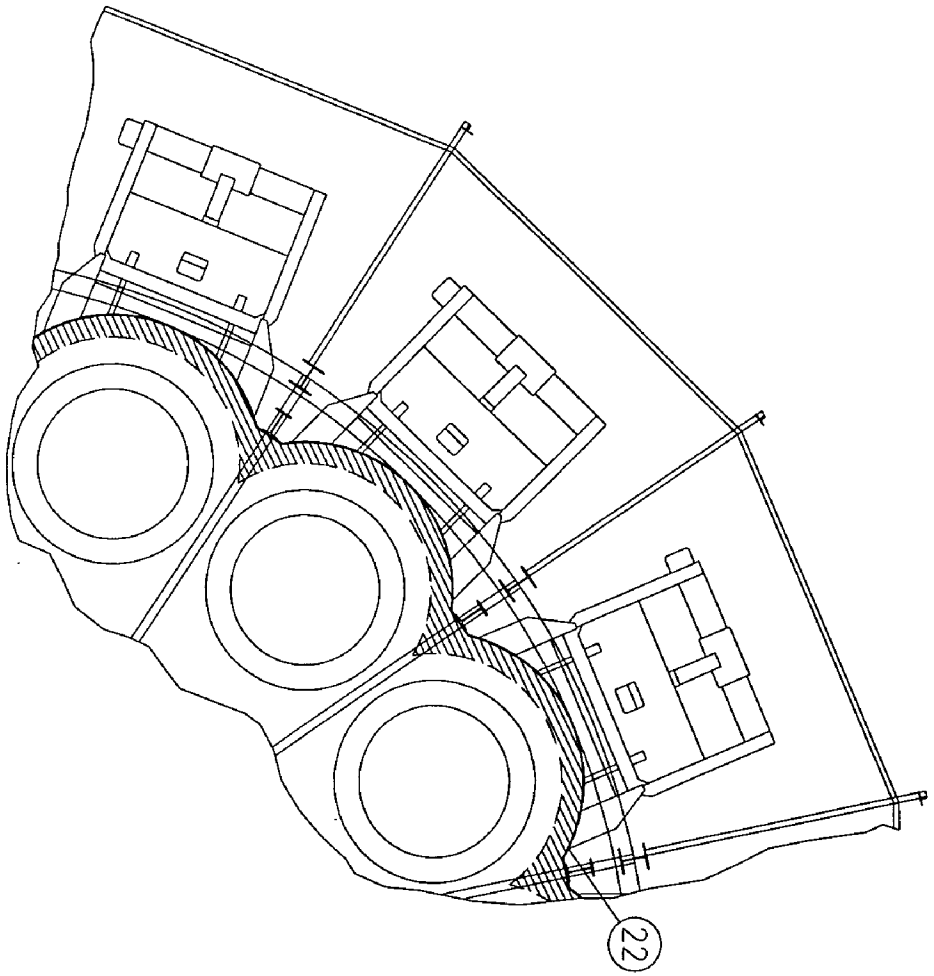
FIG. 5 is a broken-away fragmentary plan view in cross-section of a portion of a preheater of the present invention.

As indicated, lower preheating area 11 is an essentially circular compartment. As such, with reference to FIG. 3, in one embodiment the distance from center point 34 of upper roof 12 to each point on the outer perimeter 22 of upper roof 13 will be equal, which profile will extend down through each horizontal plane of lower preheating chamber 11. Alternatively and preferably, in a unique feature of this invention, the outer perimeter 22 of upper roof 13 and, correspondingly, the outer surface of lower preheating area 11 will be "knuckled-shaped", as illustrated in FIGS. 3 and 5. In such a configuration, the longest distance from center point 34 of upper roof 13 to the outer perimeter 22 of the roof is when measured through center point 35 of each hole 23 in upper roof 13. The shortest distance from the center point 34 of upper roof 13 to the perimeter 22 of the roof is the distance when measured through a point 37 on perimeter 22 equidistant from center point 35 of adjacent holes 33, assuming holes 33 are equally sized and spaced, from each other and perimeter 22. This profile will extend downward through each horizontal plane of lower preheating chamber 11. This "knuckle-shaped" configuration serves to eliminate "dead-zones" in the lower preheating chamber, that is, areas in the chamber where the material would not be in a state of movement.

Feed and preheating cassettes 30 are a unique feature of the present invention. Referring to FIG. 2, the cassettes are arrayed in a ring or a semi-circle on top of upper side 14 of roof 13. Cassettes 30 are preferably identical in size and shape and, further, are preferably evenly spaced and separate and distinct from each other. In addition, cassettes 30 are preferably uniformly spaced from outer perimeter 22. As a result of the placement of cassettes 30, material discharged from each cassette 30 will, through its natural angle of repose, form piles 40 on the sloped floor which are spaced from both (a) the material piles discharged from each immediately adjacent feed cassette 30 and (b) side walls 17 of lower preheater area 11. As a result, it is an unique feature of this invention that preheating air will have an easy passage between each of the material piles 40 and also through an annular passageway formed by the space between each material pile 40 and side walls 17 of lower preheating chamber 11, thus ensuring substantial and uniform material/air contact throughout lower preheating area 11. With reference to FIGS. 1 and 2, preheating air will travel radially from discharge 19 between material piles 40 via passageways 50 (only one of which is depicted in FIG. 2), which are formed between adjacent material piles 40 by the natural angle of repose of each material pile 40. The air will travel through passageways 50 to the inner side wall 17 of the preheater. Once there, the air will travel along rear annular air passageway 51 which, when cassettes 30 form a ring on upper side 14 of roof 13, extends completely around the inner perimeter of the lower preheating chamber and which is the result of the placement of cassettes 30 away from perimeter 22 and the natural angle of repose of the material piles from each cassette 30.

The bottom portion 30*a* of each feed cassette 30 can be flush against the upper surface 14 of flat roof 13. Preferably, however, bottom portion 30*a* will extend slightly below the lower surface 15 of roof 13 and into (by no more than approximately 6 inches) lower chamber 11. This feature is advantageous because by varying the extent by which the bottom portion 30*a* of feed cassettes 30 extent into lower chamber 11 the size and shape of air passageway 51 will be varied and thereby the air distributorship through air passageway 51 can be optimized based on the characteristics of the particulate material being processed.

Whether cassettes 30 are flush against surface 15 of roof 13 or extend into lower chamber 11, the position and sizing of cassettes 30 relative to holes 33 will be such that all of the preheating air that exits lower chamber 11 through holes 33 will go into cassettes 30. Therefore, if cassettes 30 are placed flush against roof 12 the size and shape of the inside diameter of cassette 30 will be matched with the size and shape of hole 33 with which it is mated. In a less preferred embodiment, cassette 30 can be larger than and overlap its respective hole 33.

Cassettes 30 are preferably made from fabricated steel and are lined with suitable refractory materials. As such, this gives the operator the option over the lifetime of the preheater to vary the cross section of cassettes 30 and/or replace feed cassette 30 to thereby vary the resultant gas velocity through the preheater as needed in a cost effective manner.

Preferably, each heating air duct 81 will exit its respective cassette 30 at no more than a 45-degree angle from the vertical. The vertical take off of heating air contributes to both the duct's possessing self-cleaning properties and reduced pressure drop.

In another feature of the invention, material feed enters each cassette essentially vertically by gravity from a centrally positioned material inlet and feed duct 70. In a preferred embodiment, inlet duct 70 enters through a location essentially in the center of upper face 38 of cassette 30. In this preferred embodiment, air intake 80 is positioned in the interior of cassette 30 directly below inlet duct 70 so that a substantial amount of feed 33 entering cassette 30 from inlet duct 70 will fall on the top of air intake 80. Coarser material 33*b* will roll around and down the side of air take off 80 air take off 80 and from there travel down through the center of feed cassette 30. Fine material 33*a* will tend to migrate toward the outer wall 32 of each cassette 30. This design will, therefore, lead to a natural segregation of fine material 33*a* from coarse material 33*b*. As coarse material 33*b* falls down cassette 30 it will form a natural angle of repose 85 underneath air intake 80. This segregation of coarse and fine materials promotes uniform gas distribution over the full cross-section of the cassette.

The feed cassettes are tubular in the broadest sense of the word, that is, they are essentially elongated, hollow bodies, having a vertical axis longer than a horizontal axis with the exact ratio of the length of the cassette's vertical to horizontal axis being determined by the needs of the individual practitioner of the invention, based on factors such as the nature and size of the material being preheated, the preheating temperatures and the desired pass through rate of the material. The feed cassettes preferably will have a symmetrical horizontal cross-sectional profile at their bottom in the vicinity where the gas will enter the cassettes, which will contribute to the even preheating of the particulate material in the cassette. Because of the unique rear annular air passageway 51 and the preferred circular symmetry at the lower gas enter area 30*b* of each cassette 30, gas will enter around the entire circumference of each cassette 30 leading to an optimal heat transfer/pressure drop trade-off.

In one embodiment, the cassettes may be fabricated as being perfectly cylindrical. In another embodiment of the invention the cassettes are fabricated as a truncated inverted cone having a decreasing cross sectional area as gases move up the stone bed. Such cassettes will have a gradual slope, typically ranging up to about 5%, with the cross-sectional area at the top of each cassette ranging from about 80% to 100% of the cross-sectional area at the bottom of each cassette. This design provides for uniform fines carrying capacity throughout the cassettes. This is an improvement over conventional, uniform cross section stone beds, in which the carrying capacity at the bed bottom gives way to less carrying capacity at the bed top—thus generating a size range of trapped particles in between the top and bottom carrying capacity. The sloped design provides for more uniform feed distribution throughout the cassette and more uniform gas solid distribution. In another embodiment, the cassettes can have the shape of hollow multi-sided prisms, such as, for example, rectangular, hexagonal and octagonal prisms. Most preferably, the horizontal cross section of the cassettes will be circular. Preferably, all the cassettes in a given preheater will be uniformly shaped and sized. Typically there will be one cassette 30 for each hole 33, although in certain embodiments, and depending on the type and characteristics of the material to be preheated, a single cassette can cover more than one hole.

Material pushing rams 90 are located underneath each cassette 30 and push preheated and precalcined material down the sloped floor toward the material discharge 19. The limestone is pushed uniformly by the reciprocating motion of the rams 90 actuated in a predetermined sequence. Rams 90 can be of the type conventionally utilized in the art—they typically have a rectangular boxed shape having a single-planed flat upper surface 93 and leading face 94, which initially contacts and moves the particulate material when the ram moves inwardly—and are connected by rods 91 to actuator assemblies 92, which provide reciprocal movement to rams 90. The sequence of operation of each ram can be electronically controlled. When an actuator assembly 92 is activated the corresponding ram moves inwardly, that is, down the sloped floor, pushing the preheated and precalcined limestone toward material discharge 19.

Figure 6:
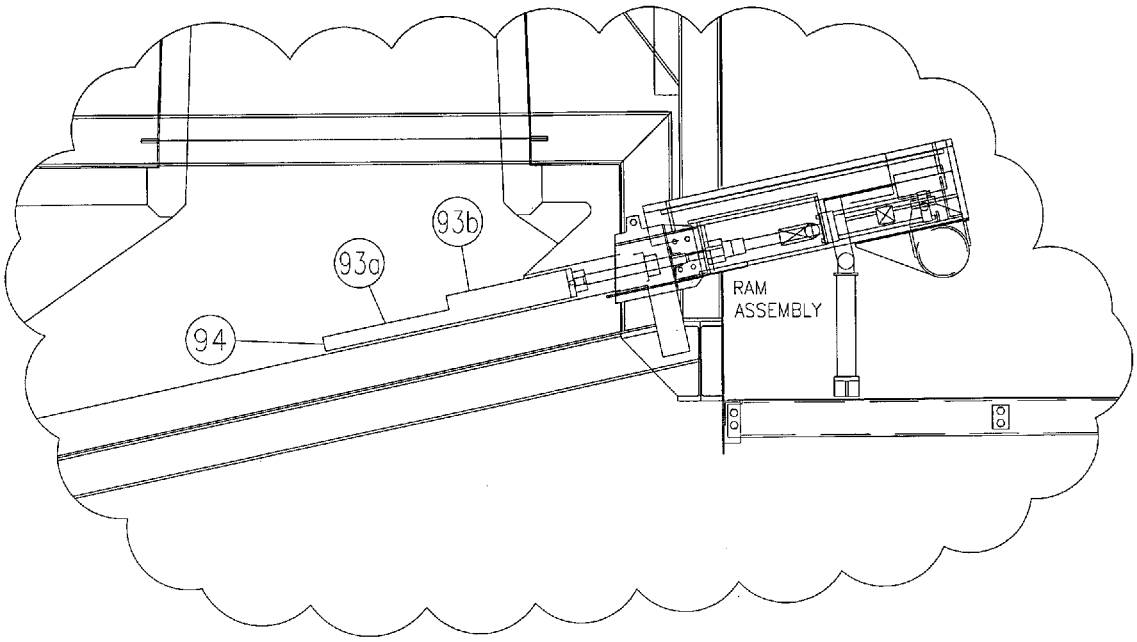
FIG. 6 is a side view of an embodiment of a ram assembly, which can be utilized in the present invention.

Alternatively, as seen in FIG. 6, rams 90 can have a stepped design, i.e., with an upper surface 93 having two or more distinct steps or upper levels 93*a* and 93*b*. The step closest to leading face 94, that is, 93*a*, is the shortest, with each succeeding step being progressively higher. This novel ram design is useful because preferential drawdown from the initial preheating cassettes 30 will correct any natural misdistribution from a uni-dimensional ram profile.

It is understood that other types of material pushers can be used in conjunction with the present invention. The material pusher can involve any type of mechanism which causes the limestone to travel down sloped floor 16 when activated.

The invention has been shown in a single preferred form and by way of example only, and many variations and modifications can be made therein within the spirit of the invention. The invention, therefore, should not be limited to any specified form or embodiment except in so far as such limitations are expressly set forth in the claims.

We claim:

1. A preheating apparatus for particulate material comprising:

(A) a lower chamber comprising (i) a sloped floor having a center section and an outer annular preheating section which circles the center section; (ii) a material outlet located in the vicinity of the center section for discharging preheated particulate material out of the chamber; (iii) a roof having a perimeter, an upper side, a lower side and a plurality of holes that extend therethrough, each of which are located near the perimeter of the roof and which are arranged in a circular array; (iv) vertical side walls which extend from the perimeter of the roof to the floor; (v) a gas inlet for receiving hot gas into the chamber for flow in countercurrent heat exchange with the particulate material and (vi) means for moving particulate material in the lower chamber toward the material outlet; and (B) an upper preheating and material delivery area comprising a plurality of essentially vertically oriented, elongated hollow feed cassettes for preheating particular material which travels down through each cassette by gravity and for delivering said preheated material to the outer annular section of the lower chamber through the holes in the roof to form material piles on the outer annular section, each cassette having (i) a top and a bottom; and (ii) a material inlet located near its top;

(iii) gas outtake means, located near its top, for collecting gas that has passed through particulate material in countercurrent heat exchange, and directing said gas out of the preheater; and (iv) a gas inlet, located at its bottom, for receiving preheating gas that passes through the holes in the roof from the lower chamber;

wherein each cassette is positioned over at least one hole, and wherein said cassettes are not in contact with and are spaced from each other and are spaced from the perimeter of the roof.

2. The apparatus of claim 1 wherein the cassettes are evenly spaced from each other.

3. The apparatus of claim 1 wherein the cassettes are evenly spaced from the perimeter of the roof.

4. The apparatus of claim 1 wherein at least one cassette is cylindrical.

5. The apparatus of claim 1 wherein at least one cassette has a truncated conical shape.

6. The apparatus of claim 1 wherein at least one cassette has, at its bottom, a symmetrical horizontal cross section.

7. The apparatus of claim 6 wherein said at least one cassette has, at its bottom, a circular horizontal cross section.

8. The apparatus of claim 1 wherein the bottom of at least one cassette extends through a hole and into the lower chamber.

9. The apparatus of claim 1 wherein the number of cassettes are equal to the number of holes in the roof.

10. The apparatus of claim 1 wherein the roof is flat.

11. The apparatus of claim 10 wherein the perimeter of the roof has a knuckle profile.

12. The apparatus of claim 1 wherein the means for moving particulate material in the lower chamber is a plurality of reciprocally movable ram-type material pushers for moving particulate material through the chamber toward the material outlet, with there being a pusher underneath each cassette.

13. The apparatus of claim 12 wherein the reciprocally movable ram-type material pushers have an upper and lower surface and a front face and rear end, wherein the upper surface of the material pusher has at least two steps, with the step closest to the front face being the lowest, and with successive step toward the rear end being higher than the preceding step.

14. The apparatus of claim 1 wherein the material inlet is located directly above the gas outtake means so that material passing through the material inlet will fall on top of the gas outtake means.

15. A preheating apparatus for particulate material comprising:

(A) a basically circular lower chamber comprising (i) a sloped floor having a center section and an outer annular preheating section which circles the center section; (ii) a material outlet located in the vicinity of the center section for discharging preheated particulate material out of the chamber; (iii) a flat, essentially circular roof having a perimeter, an upper side, a lower side and a plurality of holes that extend therethrough which are arranged in a circular array near the perimeter of the roof; (iv) vertical side walls which extend from the perimeter of the roof to the floor; (v) a gas inlet for receiving hot gas into the chamber for flow in countercurrent heat exchange with the particulate material; and (vi) means for moving particulate material in the lower chamber toward the material outlet; and (B) an upper preheating and material delivery area comprising a plurality of essentially vertically oriented, elongated hollow feed cassettes for preheating particular material which travels down through each cassette by gravity and for delivering said preheated material to the outer annular section of the lower chamber through the holes in the roof to form material piles on the outer annular section, each cassette being evenly spaced from each other evenly spaced from the perimeter of the roof, and having (i) a top and a bottom; and (ii) a material inlet located near its top;

(iii) a gas outlet, located near its top, for receiving gas has passed through particulate material in countercurrent heat exchange, with said gas exiting the cassette through a gas duct connected to the gas outlet;

(iv) a gas inlet, located at its bottom, for receiving preheating gas through that passes through the holes in the roof from the lower chamber; and (v) a truncated conical shape and a symmetrical horizontal cross section;

wherein each cassette is positioned over at least one hole, and wherein said cassettes are not in contact with and are spaced from each other and are spaced the perimeter of the roof.

16. The apparatus of claim 15 wherein the bottom of at least one cassette extends through a hole and into the lower chamber.

17. The apparatus of claim 15 wherein the number of cassettes are equal to the number of holes in the roof.

18. The apparatus of claim 15 wherein the perimeter of the roof has a knuckle profile.

19. The apparatus of claim 15 wherein the means for moving particulate material in the lower chamber is a plurality of reciprocally movable ram-type material pushers for moving particulate material through the chamber toward the material outlet, with there being a pusher underneath each cassette.

20. The apparatus of claim 19 wherein the reciprocally movable ram-type material pushers have an upper and lower surface and a front face and rear end, wherein the upper surface of the material pusher has at least two steps, with the step closest to the front face being the lowest, and with successive step toward the rear end being higher than the preceding step.

21. The apparatus of claim 15 wherein the material inlet is located directly above the gas outtake means so that material passing through the material inlet will fall on top of the gas outtake means.

22. The apparatus of claim 15 wherein the duct will exit the cassette at no more than a 45-degree angle from the vertical.

* * * * *